US012281828B2

(12) United States Patent
In et al.

(10) Patent No.: US 12,281,828 B2
(45) Date of Patent: Apr. 22, 2025

(54) AIR CONDITIONER AND CONTROL METHOD THEREOF

(71) Applicant: SAMSUNG ELECTRONICS CO., LTD., Suwon-si (KR)

(72) Inventors: Sungjin In, Suwon-si (KR); Youngjin Kim, Suwon-si (KR); Beomseok Seo, Suwon-si (KR); Daechul Han, Suwon-si (KR); Hyoju Moon, Suwon-si (KR); Leegyu Son, Suwon-si (KR); Manki Ha, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 187 days.

(21) Appl. No.: 17/889,571

(22) Filed: Aug. 17, 2022

(65) Prior Publication Data

US 2023/0126973 A1 Apr. 27, 2023

Related U.S. Application Data

(63) Continuation of application No. PCT/KR2022/011346, filed on Aug. 2, 2022.

(30) Foreign Application Priority Data

Oct. 21, 2021 (KR) ..... 10-2021-0141204

(51) Int. Cl.
*F25B 49/02* (2006.01)
*F25B 41/31* (2021.01)
*F25B 47/02* (2006.01)

(52) U.S. Cl.
CPC ..... *F25B 49/022* (2013.01); *F25B 41/31* (2021.01); *F25B 47/022* (2013.01);
(Continued)

(58) Field of Classification Search
CPC ..... F25B 49/022; F25B 41/31; F25B 47/022; F25B 2500/06; F25B 2700/13; F25B 2700/2103; F25B 2700/2106
See application file for complete search history.

(56) References Cited

U.S. PATENT DOCUMENTS 4,381,549 A 4/1983 Stamp, Jr. et al.
5,970,727 A * 10/1999 Hiraoka ..... F25B 47/02 62/193

(Continued)

FOREIGN PATENT DOCUMENTS

CN 107560105 A * 1/2018
CN 109405173 A * 3/2019

(Continued)

OTHER PUBLICATIONS

Jianfeng et al., Pipe Connector Error Judging Method . . . , Sep. 1, 2018, CN107560105A, Whole Document (Year: 2018).*

(Continued)

*Primary Examiner* — Larry L Furdge
(74) *Attorney, Agent, or Firm* — STAAS & HALSEY LLP

(57) ABSTRACT

An air conditioner and a control method thereof. The air conditioner includes an indoor unit including an indoor heat exchanger and an indoor fan, an outdoor unit connected to the indoor unit and including an outdoor heat exchanger, an outdoor fan, a compressor, an expansion valve, and a four-way valve, and at least one processor configured to perform a test operation by controlling the indoor unit and the outdoor unit. Based on an outdoor temperature being less than a predetermined reference temperature, the at least one processor is configured to determine whether the indoor unit (Continued)

and the outdoor unit operate normally, by continuously performing a heating operation and a defrosting operation during the test operation.

15 Claims, 8 Drawing Sheets

(52) U.S. Cl.
CPC ..... *F25B 2500/06* (2013.01); *F25B 2700/13* (2013.01); *F25B 2700/2103* (2013.01); *F25B 2700/2106* (2013.01)

(56) References Cited

U.S. PATENT DOCUMENTS

| | | | |
|---|---|---|---|
| 11,835,428 | B2 | 12/2023 | Son et al. |
| 2006/0086103 | A1 | 4/2006 | Lee et al. |
| 2021/0293460 | A1 | 9/2021 | Uehara et al. |
| 2021/0302054 | A1* | 9/2021 | Delgoshaei ..... F24F 11/38 |

FOREIGN PATENT DOCUMENTS

| | | | |
|---|---|---|---|
| JP | 2001-91012 | | 4/2001 |
| JP | 4522690 | | 8/2010 |
| JP | 5927500 | | 6/2016 |
| JP | 6126970 | | 4/2017 |
| JP | 2018-132235 | | 8/2018 |
| KR | 20000014064 | A * | 3/2000 |
| KR | 10-2001-0028948 | | 4/2001 |
| KR | 2001-0048700 | | 6/2001 |
| KR | 10-2006-0089441 | | 8/2006 |
| KR | 10-2006-0124959 | | 12/2006 |
| KR | 10-0896283 | | 5/2009 |
| KR | 10-1203576 | | 11/2012 |
| KR | 10-2014-0018782 | | 2/2014 |
| KR | 10-1657559 | | 9/2016 |
| KR | 10-2017-0082765 | | 7/2017 |
| KR | 10-1929854 | | 12/2018 |
| KR | 10-2206199 | | 1/2021 |
| KR | 10-2022-0095071 | | 7/2022 |

OTHER PUBLICATIONS

Sim, Device for Sensing Wrong-Connected Line of Multi Air Conditioner and Sensing Method Thereof, Jun. 3, 2000, KR20000014064A, Whole Document (Year: 2000).*

Zhang et al., Method for Detecting Internal Leakage of Electronic Expansion Valve . . . , Mar. 1, 2019, CN109405173A, Whole Document (Year: 2019).*

International Search Report dated Nov. 7, 2022 in International Patent Application No. PCT/KR2022/011346 (3 pages; 4 pages English translation).

PCT/ISA/237 dated Nov. 7, 2022 in International Patent Application No. PCT/KR2022/011346.

Extended European Search Report issued Aug. 30, 2024 for European Patent Application No. 22883728.2.

* cited by examiner

AIR CONDITIONER AND CONTROL METHOD THEREOF

CROSS-REFERENCE TO RELATED APPLICATION(S)

This application is a continuation application, under 35 U.S.C. §111(a), of International Application No. PCT/KR2022/011346, filed on Aug. 2, 2022, which claims priority to Korean Patent Application No. 10-2021-0141204, filed on Oct. 21, 2021, in the Korean Intellectual Property Office, the disclosure of which is incorporated by reference herein in its entirety.

BACKGROUND

1. Field

The disclosure relates to an air conditioner capable of performing a test operation by performing a cooling operation or a heating operation according to an outdoor temperature, and a control method thereof.

2. Description of Related Art

An air conditioner is a device that cools or heats air by transferring of heat generated by evaporation and condensation of a refrigerant, and discharges the cooled or heated air to condition air in an indoor space. The air conditioner may cool or heat an indoor space by circulating a refrigerant through a compressor, an indoor heat exchanger, and an outdoor heat exchanger during a cooling operation or a heating operation, and discharging air heat-exchanged in the indoor heat exchanger to the indoor space.

Meanwhile, after installing the air conditioner, a test operation of the air conditioner is required to check a normal operation of the air conditioner. In a conventional manner, during the test operation of the air conditioner, it is checked whether the air conditioner operates normally while only performing the cooling operation. Therefore, when the outdoor temperature is relatively low, such as in the winter, it is difficult to properly perform the test operation of the air conditioner.

SUMMARY

Additional aspects of the disclosure will be set forth in part in the description which follows and, in part, will be obvious from the description, or may be learned by practice of the disclosure.

In accordance with an aspect of the disclosure, an air conditioner includes an indoor unit including an indoor heat exchanger and an indoor fan, an outdoor unit connected to the indoor unit and including an outdoor heat exchanger, an outdoor fan, a compressor, an expansion valve, an outdoor temperature sensor, and a four-way valve, and at least one processor configured to perform a test operation to determine whether the indoor unit and the outdoor unit are operating normally by controlling the indoor unit and the outdoor unit to continuously perform a heating operation and a defrosting operating during the test operation. Wherein the test operation is based on an outdoor temperature detected by the outdoor temperature sensor being less than a predetermined reference temperature.

The at least one processor may be configured to switch the operation to the defrosting operation from the heating operation by controlling the compressor and the four-way valve, in response to the completion of the heating operation.

The at least one processor may be configured to terminate the defrosting operation based on a temperature of the outdoor heat exchanger detected by an outdoor heat exchanger temperature sensor being greater than or equal to a defrost cancellation temperature, and determine that the four-way valve and the expansion valve operate normally.

The at least one processor may be configured to determine whether a refrigerant flow is normal, based on a first temperature of the indoor heat exchanger detected by an indoor heat exchanger outlet temperature sensor before driving the compressor for the heating operation, and a second temperature of the indoor heat exchanger detected by the indoor heat exchanger outlet temperature sensor after driving the compressor for a predetermined time.

The at least one processor may be configured to determine that the refrigerant flow is abnormal, based on a difference between the first temperature of the indoor heat exchanger and the second temperature of the indoor heat exchanger, being less than a predetermined reference value.

The air conditioner may further include a control panel provided on at least one of the indoor unit or the outdoor unit. Based on the abnormality of the refrigerant flow, the at least one processor may be configured to control the control panel to display an error message indicating at least one of an abnormal operation of the four-way valve, an abnormal operation of the expansion valve, or a closure of a pipe valve coupled to a pipe.

The at least one processor may be configured to determine whether a communication state between the indoor unit and the outdoor unit is normal before the start of the heating operation.

The at least one processor may be configured to determine whether the indoor fan and the outdoor fan operate normally before the start of the heating operation.

The air conditioner may further include a control panel provided on at least one of the indoor unit or the outdoor unit. Based on the detection of an abnormal operation related to at least one of the indoor unit or the outdoor unit, the at least one processor may be configured to control the control panel to display an error message related to the abnormal operation and to stop the test operation.

In accordance with another aspect of the disclosure, a control method of an air conditioner including an indoor unit and an outdoor unit, the control method includes performing a test operation of the indoor unit and the outdoor unit based on an input of a test operation command. The performing of the test operation includes detecting an outdoor temperature by an outdoor temperature sensor, determining whether the indoor unit and the outdoor unit operate normally based on the outdoor temperature being less than a predetermined reference temperature, by continuously performing a heating operation and a defrosting operation, and displaying information related to whether the indoor unit and the outdoor unit operate normally.

The continuously performing of the heating operation and the defrosting operation may include switching the operation to the defrosting operation from the heating operation by controlling a compressor and a four-way valve, in response to the completion of the heating operation.

The determination of whether the indoor unit and the outdoor unit operate normally may include terminating the defrosting operation based on a temperature of an outdoor heat exchanger detected by an outdoor heat exchanger temperature sensor being greater than or equal to a defrost cancellation temperature, and determining that the four-way valve and an expansion valve operate normally.

The determination of whether the indoor unit and the outdoor unit operate normally may include determining whether a refrigerant flow is normal, based on a first temperature of an indoor heat exchanger detected by an indoor heat exchanger outlet temperature sensor before driving the compressor for the heating operation, and a second temperature of the indoor heat exchanger detected by the indoor heat exchanger outlet after driving the compressor for a predetermined time.

The determination of whether the refrigerant flow is normal may include determining that the refrigerant flow is abnormal, based on a difference between the first temperature of the indoor heat exchanger and the second temperature of the indoor heat exchanger, being less than a predetermined reference value.

The displaying of the information may include displaying an error message indicating at least one of an abnormal operation of the four-way valve, an abnormal operation of the expansion valve, or a closure of a pipe valve coupled to a pipe, based on the abnormality of the refrigerant flow.

The performing of the test operation may further include determining whether a communication state between the indoor unit and the outdoor unit is normal before the start of the heating operation.

The performing of the test operation may further include determining whether an indoor fan and an outdoor fan operate normally before the start of the heating operation.

The displaying of the information may include displaying an error message related to the abnormal operation based on the detection of the abnormal operation related to the at least one of the indoor unit or the outdoor unit.

BRIEF DESCRIPTION OF THE DRAWINGS

The above and other aspects, features, and advantages of certain embodiments of the present disclosure will be more apparent from the following description taken in conjunction with the accompanying drawings of which.

DETAILED DESCRIPTION

Figure 1:
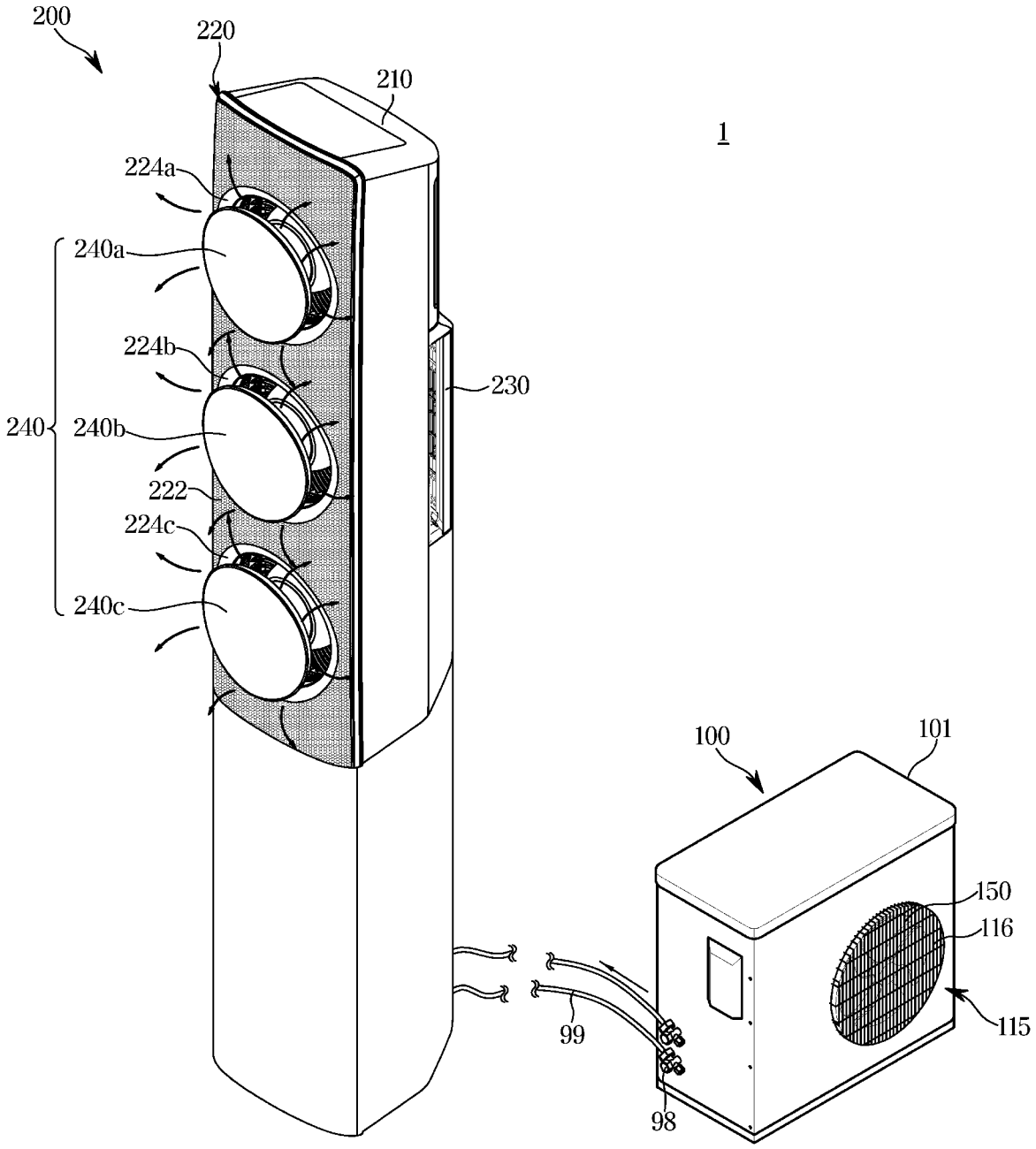
FIG. 1 is an external view illustrating an air conditioner according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

It will be understood that when an element is referred to as being "connected" another element, it can be directly or indirectly connected to the other element, wherein the indirect connection includes "connection via a wireless communication network".

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element.

In the following description, terms such as "unit", "part", "block", "member", and "module" indicate a unit for processing at least one function or operation. For example, those terms may refer to at least one process processed by at least one hardware such as Field Programmable Gate Array (FPGA), Application Specific Integrated Circuit (ASIC), at least one software stored in a memory or a processor An identification code is used for the convenience of the description but is not intended to illustrate the order of each step. The each step may be implemented in the order different from the illustrated order unless the context clearly indicates otherwise.

Therefore, it is an aspect of the disclosure to provide an air conditioner capable of performing a test operation by performing a cooling operation in response to an outdoor temperature being greater than a reference temperature, and capable of performing a test operation by continuously performing a heating operation and a defrosting operation in response to an outdoor temperature being less than or equal to the reference temperature.

The disclosure will be described more fully hereinafter with reference to the accompanying drawings.

FIG. 1 is an external view illustrating an air conditioner according to an embodiment of the disclosure.

Referring to FIG. 1, an air conditioner 1 includes an outdoor unit 100 arranged in an outdoor space to perform heat exchange between outdoor air and a refrigerant, and an indoor unit 200 arranged in an indoor space to perform heat exchange between indoor air and a refrigerant. The outdoor unit 100 may be located outside an air conditioning space, and the indoor unit 200 may be located within an air conditioning space. The air conditioning space means a space cooled or heated by the air conditioner 1. For example, the outdoor unit 100 may be arranged outside a building, and the indoor unit 200 may be arranged in a space separated from the outside by a wall, such as a living room or an office.

The outdoor unit 100 and the indoor unit 200 are connected through an external pipe 99. The refrigerant may circulate through the outdoor unit 100, the external pipe 99, and the indoor unit 200. One end of the external pipe 99 may be connected to a pipe valve 98 provided on one side of the outdoor unit 100. Further, the external pipe 99 may be connected to a refrigerant pipe arranged inside the outdoor unit 100 and the indoor unit 200.

A blow port 115 may be arranged on a housing 101 of the outdoor unit 100, and an outdoor fan 150 may be exposed through the blow port 115. A cover net 116 protecting the outdoor fan 150 may be provided at the blow port 115.

The indoor unit 200 may include a body case 210 and a front panel 220 including an upper region 221 and a lower region 223. In addition, the indoor unit 200 may include at least one air outlet 224: 224*a*, 224*b*, and 224*c* of the front panel 220 and at least one door 240 configured to open and close the air outlet 224. For example, the door 240 may include a first door 240*a*, a second door 240*b*, and a third door 240*c*. The air outlet 224 may include a first air outlet 224*a*, a second air outlet 224*b*, and a third air outlet 224*c*. The air outlet 224 and the door 240 may be provided in the upper region 221 of the front panel 220. The front panel 220 may include a plurality of holes 222 distinguished from the air outlet 224. The plurality of holes 222 may be provided in a region in which the air outlet 224 is not formed. A size of each of the plurality of holes 222 is less than a size of the air outlet 224.

The air outlet 224 is provided to allow heat-exchanged air to be directly discharged to the outside. That is, the air outlet 224 may be provided to be exposed to the outside of the indoor unit 200. As the door 240 opens or closes the air outlet 224, the heat-exchanged air may be selectively discharged to the outside of the indoor unit 200 through the air outlet 224. In response to the air outlet 224 being opened by the door 240, the heat-exchanged air may be discharged through the air outlet 224. For example, the first door 240*a* may open the first air outlet 224*a*, the second door 240*b* may open the second air outlet 224*b*, and the third door 240*c* may close the third air outlet 224*c*. In this case, the heat-exchanged air may be discharged through the first air outlet 224a and the second air outlet 224*b*, and the heat-exchanged air may not be discharged from the third air outlet 224*c*.

The door 240 and the air outlet 224 may be provided in the same number and may be arranged to correspond one-to-one. The door 240 may include a shape corresponding to a shape of the air outlet 224. For example, the air outlet 224 and the door 240 may be circular. The door 240 may be moved between an open position in which the air outlet 224 is opened and a closed position in which the air outlet 224 is closed. The door 240 may be moved forward and backward between the open position and the closed position. The door 240 may be moved by a door actuator (not shown).

An indoor fan 260 arranged inside the indoor unit 200 may be arranged inside the body case 210 to correspond to the air outlets 224: 224*a*, 224*b*, and 224*c*. The number of indoor fans 260 may correspond to the number of air outlets 224. The indoor fan 260 may include a fan motor, and the indoor fan 260 may be rotated by using power generated by the fan motor. In a state in which a plurality of indoor fans 260 is provided, each indoor fan 260 may be controlled to operate at the same rotation speed or at different rotation speeds.

An air inlet 230 may be provided at the rear of the body case 210. Air introduced into the air inlet 230 may be heat exchanged in a heat exchanger 30, and the heat-exchanged air may be discharged to the outside of the indoor unit 200 (an indoor space) through the air outlet 224. The heat-exchanged air may be discharged to the outside of the indoor unit 200 (the indoor space) through the plurality of holes 222 of the front panel 220.

In other words, in response to the air outlet 224 being opened by the door 240, the heat-exchanged air may be discharged into the indoor space through the air outlet 224 and the plurality of holes 222 of the front panel 220. In response to the air outlet 224 being closed by the door 240, the heat-exchanged air may be discharged to the outside of the indoor unit 200 (the indoor space) through the plurality of holes 222 of the front panel 220. A flow velocity of the air discharged through the plurality of holes 222 may be less than a flow velocity of the air discharged through the air outlet 224. The indoor unit 200 may control the door 240 to open or close the air outlet 224, and may change an outlet flow path of the air introduced into the air inlet 230.

It is described that the air conditioner 1 includes a single outdoor unit 100 and a single indoor unit 200, but the air conditioner 1 may include a plurality of outdoor units 100 and a plurality of indoor units 200. For example, the plurality of indoor units 200 may be connected to the single outdoor unit 100. In addition, the shape of the indoor unit 200 is not limited thereto. Therefore, any type of indoor unit 200 may be applied as long as an indoor unit 200 is installed in an indoor space and capable of cooling or heating the indoor space.

Figure 2:
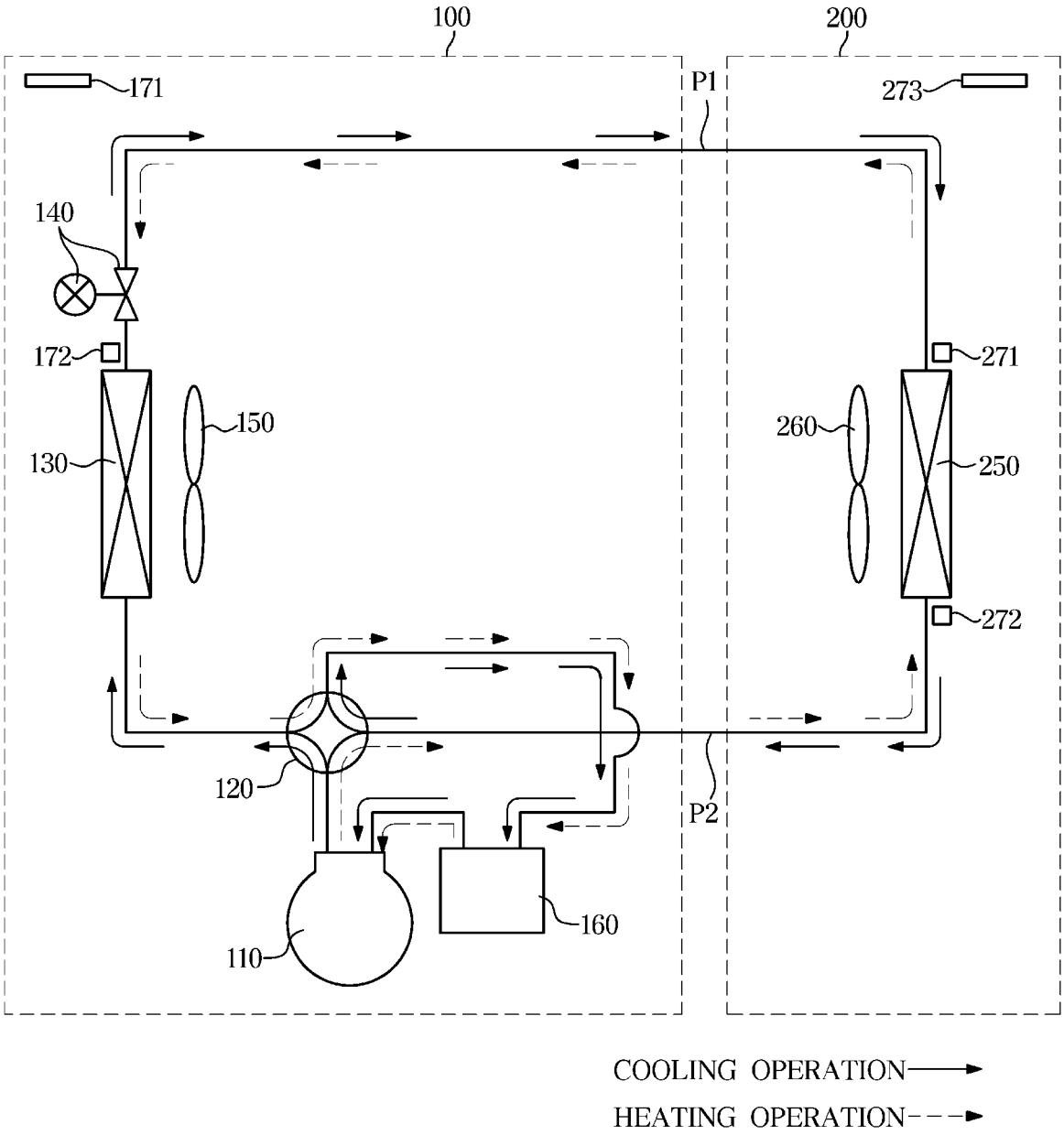
FIG. 2 is a view illustrating a flow of refrigerant when the air conditioner according to an embodiment performs a heating operation or a cooling operation.

FIG. 2 is a view illustrating a flow of refrigerant when the air conditioner according to an embodiment performs a heating operation or a cooling operation.

Referring to FIG. 2, the air conditioner 1 includes a refrigerant flow path for circulating the refrigerant between the indoor unit 200 and the outdoor unit 100. While the refrigerant circulates through the indoor unit 200 and the outdoor unit 100 along the refrigerant flow path, the refrigerant may absorb or release heat through a change in state (for example, change from a gaseous state to a liquid state or change from a liquid state to a gaseous state). The air conditioner 1 may include a liquid pipe P1 provided to connect between the outdoor unit 100 and the indoor unit 200 and provided to serve as a passage through which a liquid refrigerant flows, and a gas pipe P2 provided to serve as a passage through which a gaseous refrigerant flows. The liquid pipe P1 and the gas pipe P2 may extend into the outdoor unit 100 and the indoor unit 200. The external pipe 99 described in FIG. 1 may form a part of the liquid pipe P1 and the gas pipe P2.

During the cooling operation, the refrigerant may release heat in an outdoor heat exchanger 130 and absorb heat in an indoor heat exchanger 250. During the cooling operation, a refrigerant compressed in a compressor 110 may be first supplied to the outdoor heat exchanger 130 through a four-way valve 120, and then supplied to the indoor heat exchanger 250 through an expansion valve 140. During the cooling operation, the outdoor heat exchanger 130 operates as a condenser for condensing the refrigerant, and the indoor heat exchanger 250 operates as an evaporator for evaporating the refrigerant.

During the cooling operation, a high-temperature and high-pressure gaseous refrigerant discharged from the compressor 110 moves to the outdoor heat exchanger 130. The liquid or near-liquid refrigerant condensed in the outdoor heat exchanger 130 is expanded and decompressed in the expansion valve 140. The two-phase refrigerant passing through the expansion valve 140 moves to the indoor heat exchanger 250. The refrigerant introduced into the indoor heat exchanger 250 is evaporated through the heat exchange with ambient air. Accordingly, a temperature of the heat-exchanged ambient air is lowered and thus cold air is discharged to the outside of the indoor unit 200.

During the heating operation, the refrigerant may release heat in the indoor heat exchanger 250 and absorb heat in the outdoor heat exchanger 130. That is, during the heating operation, the refrigerant compressed by the compressor 110 may be first supplied to the indoor heat exchanger 250 through the four-way valve 120 and then supplied to the outdoor heat exchanger 130. In this case, the indoor heat exchanger 250 operates as a condenser for condensing the refrigerant, and the outdoor heat exchanger 130 operates as an evaporator for evaporating the refrigerant.

During the heating operation, a high-temperature and high-pressure gaseous refrigerant discharged from the compressor 110 moves to the indoor heat exchanger 250. The high-temperature and high-pressure gaseous refrigerant passing through the indoor heat exchanger 250 exchanges heat with low-temperature and low-humidity air. While the refrigerant is condensed into a liquid or near-liquid refrigerant, the refrigerant releases heat and air absorbs heat. Accordingly, warm air is discharged to the outside of the indoor unit 200.

The outdoor unit 100 includes the compressor 110 configured to compress a refrigerant, the outdoor heat exchanger 130 configured to perform heat exchange between outdoor air and a refrigerant, the four-way valve 120 configured to guide the refrigerant, which is compressed by the compressor 110, to the outdoor heat exchanger 130 or the indoor heat exchanger 250 based on the cooling operation or the heating operation, the expansion valve 140 configured to decompress a refrigerant, and an accumulator 160 configured to prevent the liquid refrigerant, which is not evaporated, from flowing into the compressor 110.

The compressor 110 may operate by receiving electric energy from an external power source. The compressor 110 includes a compressor motor (not shown), and compresses a low-pressure gaseous refrigerant into a high-pressure gaseous refrigerant using a rotational force of the compressor motor. The compressor 110 may change an operating frequency to correspond to the capability required by the indoor unit 200. The compressor 110 may be an inverter air compressor, a positive displacement compressor, or a dynamic compressor, and various types of compressors that a designer may consider.

The four-way valve 120 may switch a flow direction of the high-temperature and high-pressure gaseous refrigerant discharged from the compressor 110. The four-way valve 120 is controlled to guide the refrigerant, which is compressed in the compressor 110, to the outdoor heat exchanger 130 during the cooling operation, and is controlled to guide the refrigerant, which is compressed in the compressor 110, to the indoor unit 200 during the heating operation.

During the cooling operation, the outdoor heat exchanger 130 serves as a condenser for condensing the refrigerant compressed in the compressor 110, and during the heating operation, the outdoor heat exchanger 130 serves as an evaporator for evaporating the refrigerant decompressed in the indoor unit 200. The outdoor heat exchanger 130 may include an outdoor heat exchanger refrigerant pipe (not shown) through which the refrigerant passes and an outdoor heat exchanger cooling fin (not shown) for increasing a surface area in contact with outdoor air. As the surface area of the outdoor heat exchanger refrigerant pipe (not shown) in contact with the outdoor air is increased, the heat exchange efficiency between the refrigerant and the outdoor air may be improved.

The outdoor fan 150 may be arranged in the vicinity of the outdoor heat exchanger 130 to move outdoor air to the outdoor heat exchanger 130. The outdoor fan 150 may blow the outdoor air before heat exchange to the outdoor heat exchanger 130 and simultaneously blow the heat-exchanged air to the outdoors. The outdoor fan 150 may discharge the air around the outdoor heat exchanger 130 to the outside, thereby dispersing heat emitted by the liquefaction of the refrigerant in the outdoor heat exchanger 130.

The expansion valve 140 may expand the high-temperature and high-pressure liquid refrigerant to discharge a low-temperature and low-pressure refrigerant in a state in which the gaseous state and the liquid state are mixed. The expansion valve 140 may adjust the amount of refrigerant provided to the indoor heat exchanger 250. The expansion valve 140 may decompress the refrigerant using a throttling action of the refrigerant in which the pressure decreases without heat exchange with the outside when the refrigerant passes through a narrow flow path. An electronic expansion valve (EEV) configured to regulate an opening degree may be used to control the amount of refrigerant passing through the expansion valve 140.

The expansion valve 140 may include a thermoelectric electronic expansion valve using deformation of a bimetal, a thermodynamic electronic expansion valve using cubical expansion by heating filled wax, a pulse width modulation type electronic expansion valve in which a solenoid valve is opened and closed by a pulse signal, and a step motor type electronic expansion valve in which a valve is opened and closed using a motor.

According to embodiments, the expansion valve 140 may be omitted from the outdoor unit 100. When the outdoor unit 100 does not include the expansion valve 140, the expansion valve 140 may be provided in the indoor unit 200.

The outdoor unit 100 may include an outdoor temperature sensor 171 configured to detect an outdoor temperature. In addition, an outdoor heat exchanger temperature sensor 172 configured to detect a temperature of the outdoor heat exchanger 130 may be provided on at least one side of the outdoor heat exchanger 130. The outdoor temperature sensor 171 and the outdoor heat exchanger temperature sensor 172 may be implemented as at least one of a bimetal thermometer, a thermistor thermometer, or an infrared thermometer.

Based on the cooling operation in which the refrigerant flows from the compressor 110 to the outdoor heat exchanger 130, the outdoor heat exchanger temperature sensor 172 may be arranged at an outlet side of the outdoor heat exchanger 130 from which the refrigerant flows. Accordingly, the outdoor heat exchanger temperature sensor 172 may be referred to as an 'outdoor heat exchanger outlet temperature sensor'. Although not shown, a temperature sensor (not shown) may also be provided on the inlet side of the outdoor heat exchanger 130, which may be referred to as an 'outdoor heat exchanger inlet temperature sensor'. In other words, a temperature sensor may be provided at each of the inlet and outlet of the outdoor heat exchanger 130. The outdoor heat exchanger temperature sensor 172 may be installed around the inlet and/or outlet of the outdoor heat exchanger 130 or installed in contact with a refrigerant pipe connected to the inlet and/or outlet of the outdoor heat exchanger 130.

Because a circulation direction of the refrigerant is opposite in the heating operation, the inlet of the outdoor heat exchanger 130 to which the refrigerant is introduced and the outlet of the outdoor heat exchanger 130 from which the refrigerant is discharged may be oppositely defined. However, for convenience of description, the inlet and outlet of the outdoor heat exchanger 130 may be described based on the cooling operation.

The indoor unit 200 may include the indoor heat exchanger 250 and the indoor fan 260. The indoor heat exchanger 250 performs the heat exchange between indoor air and a refrigerant. The indoor fan 260 may move indoor air to the indoor heat exchanger 250. The indoor fan 260 may be provided in plurality.

The indoor heat exchanger 250 serves as an evaporator for evaporating a low-pressure liquid refrigerant during the cooling operation and serves as a condenser for condensing a high-pressure gaseous refrigerant during the heating operation. In the same as the outdoor heat exchanger 130 of the outdoor unit 100, the indoor heat exchanger 250 includes an indoor heat exchanger refrigerant pipe (not shown) through which the refrigerant passes, and an indoor heat exchanger cooling fin (not shown) for improving the heat exchange efficiency between the refrigerant and the indoor air.

The indoor fan 260 may be provided around the indoor heat exchanger 250 to blow indoor air to the indoor heat exchanger 250. The indoor heat exchanger 250 may perform heat exchange with indoor air. The indoor fan 260 may blow the indoor air before heat exchange to the indoor heat exchanger 250 and simultaneously blow the heat-exchanged air into the indoor space.

Indoor heat exchanger temperature sensors 271 and 272 configured to detect a temperature of the indoor heat exchanger 250 may be provided on both sides (an inlet and an outlet) of the indoor heat exchanger 250. The indoor heat exchanger temperature sensors 271 and 272 may be installed around the inlet and/or outlet of the indoor heat exchanger 250 or installed in contact with a refrigerant pipe connected to the inlet and/or outlet of the indoor heat exchanger 250.

The indoor heat exchanger temperature sensors 271 and 272 may include an indoor heat exchanger inlet temperature sensor 271 and an indoor heat exchanger outlet temperature sensor 272. The indoor heat exchanger inlet temperature sensor 271 may detect a temperature of the inlet of the indoor heat exchanger 250, and the indoor heat exchanger outlet temperature sensor 272 may detect a temperature of the outlet of the indoor heat exchanger 250. The inlet of the indoor heat exchanger 250 into which the refrigerant is introduced and the outlet of the indoor heat exchanger 250 from which the refrigerant is discharged may be defined oppositely to each other in the cooling operation and the heating operation. However, for convenience of description, the inlet and outlet of the indoor heat exchanger 250 may be described based on the cooling operation.

An indoor temperature sensor 273 configured to detect the indoor temperature may be provided inside the indoor unit 200. The indoor heat exchanger temperature sensors 271 and 272 and the indoor temperature sensor 273 may be implemented as at least one of a bimetal thermometer, a thermistor thermometer, or an infrared thermometer.

Further, the air conditioner 1 may include various temperature sensors.

Figure 3:
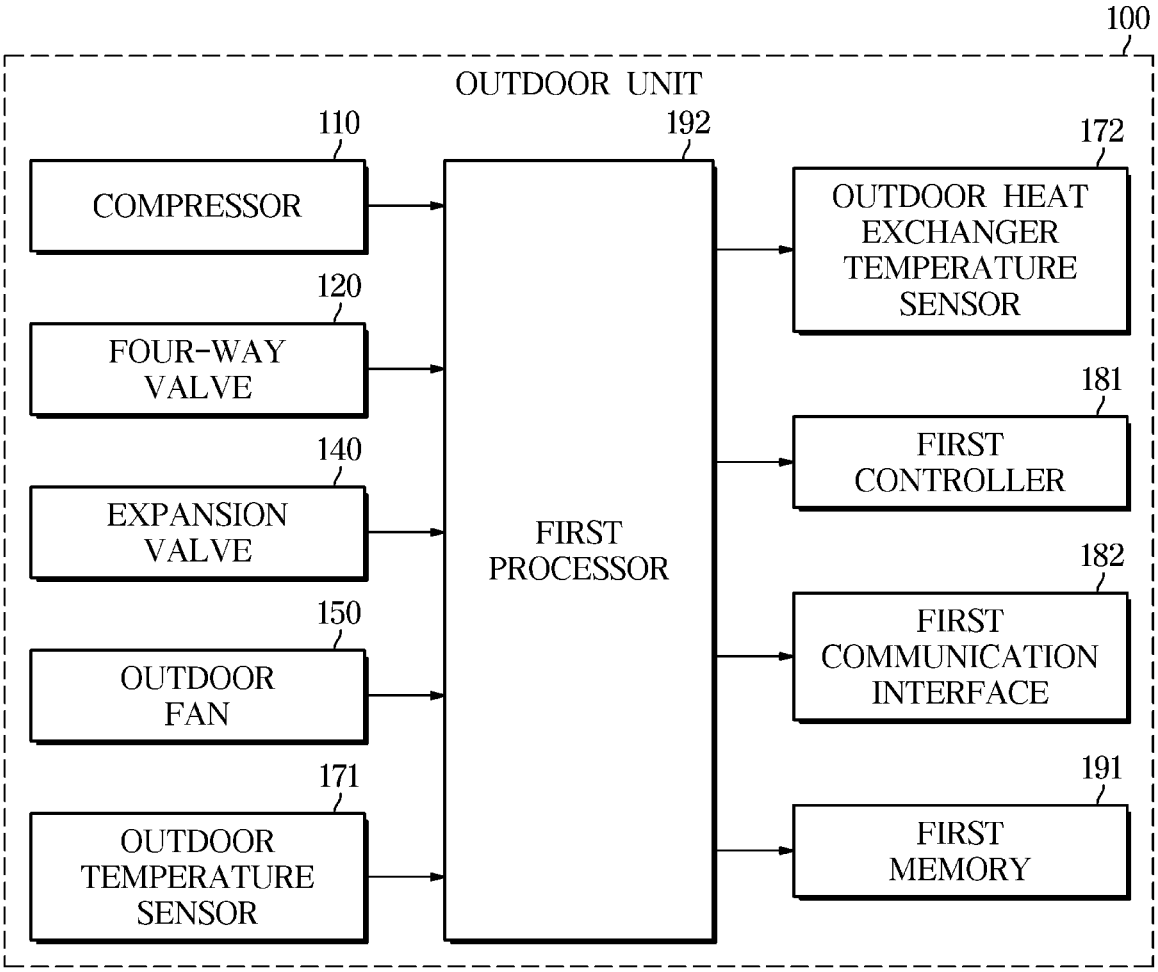
FIG. 3 is a diagram illustrating a control configuration of an outdoor unit according to an embodiment of the disclosure.

FIG. 3 is a diagram illustrating a control configuration of the outdoor unit according to an embodiment of the disclosure.

Referring to FIG. 3, the outdoor unit 100 of the air conditioner 1 may include the compressor 110, the four-way valve 120, the expansion valve 140, the outdoor fan 150, the outdoor temperature sensor 171, the outdoor heat exchanger temperature sensor 172, a first control panel 181, a first communication interface 182, a first memory 191, and a first processor 192.

The first processor 192 may be electrically connected to the components of the outdoor unit 100 and may control the operation of each component. For example, the first processor 192 may control the compressor 110 to adjust the operating frequency, control the four-way valve 120 to change the circulation direction of the refrigerant, and regulate the opening degree of the expansion valve 140. The first processor 192 may adjust the rotation speed of the outdoor fan 150. The rotation speed of the outdoor fan 150 may be adjusted according to the outdoor temperature.

In response to a control signal of the first processor 192, the compressor 110 may circulate the refrigerant on a refrigerant circulation circuit including the compressor 110, the four-way valve 120, the outdoor heat exchanger 130, the expansion valve 140, and the indoor heat exchanger 250. The compressor 110 may compress a gaseous refrigerant and discharge a high-temperature and high-pressure gaseous refrigerant. Further, the compressor 110 may not operate in a blowing operation that does not require cooling and heating.

Under the control of the processor 150, the four-way valve 120 may switch the circulation direction of the refrigerant discharged from the compressor 110. The four-way valve 120 guides the refrigerant compressed in the compressor 110 to the outdoor heat exchanger 130 during the cooling operation, and guides the refrigerant compressed in the compressor 110 to the indoor heat exchanger 250 during the heating operation.

The expansion valve 140 may decompress the refrigerant. In addition, the expansion valve 140 may adjust the amount of the supplied refrigerant for the sufficient heat exchange in the outdoor heat exchanger 130 or the indoor heat exchanger 250. The expansion valve 140 decompresses the refrigerant by using a throttling action of the refrigerant in which the pressure decreases while the refrigerant passes through a narrow flow path.

The outdoor temperature sensor 171 may transmit an electrical signal corresponding to the detected outdoor temperature to the first processor 192. The outdoor heat exchanger temperature sensor 172 may transmit an electrical signal corresponding to the detected inlet temperature and/or outlet temperature of the outdoor heat exchanger to the first processor 192.

The first control panel 181 may be provided in the housing 101 of the outdoor unit 100. The first control panel 181 may obtain a user input related to the operation of the air conditioner 1, and may output information regarding the operation of the air conditioner 1. The first control panel 181 may transmit an electrical signal (voltage or current) corresponding to a user input to the first processor 192. The first processor 192 may control the operation of the air conditioner 1 based on the electrical signal transmitted from the first control panel 181.

The first control panel 181 may include a plurality of buttons. For example, the plurality of buttons may include a push switch and a membrane switch actuated by a user's pressing, and/or a touch switch actuated by contact with a body part of the user. As an example of the plurality of buttons, a test operation button (not shown) configured to receive a test operation command of the air conditioner 1 may be provided.

The first control panel 181 may include a display. The first control panel 181 may display information input by the user or information provided to the user on various screens. For example, the first control panel 181 may output information such as an error message, a test operation progress rate, and a test operation result generated during a test operation of the air conditioner 1, on the display.

The first control panel 181 may include various types of display panels. For example, the first control panel 181 may include a liquid crystal display (LCD) Panel, a light emitting diode (LED) panel, or an organic light emitting diode (OLED) Panel, or a micro-LED panel. The first control panel 181 may be implemented as a touch display. The touch display may include a display panel provided to display an image and a touch panel provided to receive a touch input. In a state in which the first control panel 181 is provided as a touch display, additional buttons may be omitted.

The first communication interface 182 may communicate with the indoor unit 200. The first communication interface 182 of the outdoor unit 100 may transmit a control signal, which is transmitted from the first processor 192, to the indoor unit 200 or transmit a control signal, which is transmitted from the indoor unit 200, to the first processor 192. In other words, the outdoor unit 100 and the indoor unit 200 may perform bidirectional communication. The outdoor unit 100 and the indoor unit 200 may transmit and receive various signals during the operation.

The first memory 191 may memorize/store various types of information necessary for the operation of the air conditioner 1. The first memory 191 may store instructions, applications, data and/or programs necessary for the operation of the air conditioner 1. For example, the first memory 191 may store a program for the test operation of the air conditioner 1.

The first memory 191 may include a volatile memory for temporarily storing data such as a static random access memory (S-RAM) and a dynamic random access memory (D-RAM), and a non-volatile memory for storing data for a long period of time such as a read only memory (ROM), an erasable programmable read only memory (EPROM), and an electronically erasable programmable read only memory (EEPROM).

The first processor 192 may generate a control signal for controlling the operation of the air conditioner 1 based on instructions, applications, data, and/or programs stored in the first memory 191. The first processor 192 corresponding to hardware may include a logic circuit and an arithmetic circuit. The first processor 192 may process data according to a program and/or instructions provided from the first memory 191, and generate a control signal according to the processing result. The first memory 191 and the first processor 192 may be implemented as one control circuit or a plurality of circuits.

Some of the above-described components of the outdoor unit 100 may be omitted, or other components may be added to the above-described components of the outdoor unit 100. It will be readily understood by those of ordinary skill in the art that the mutual positions of the components may be changed in accordance with the performance or structure of the system.

Figure 4:
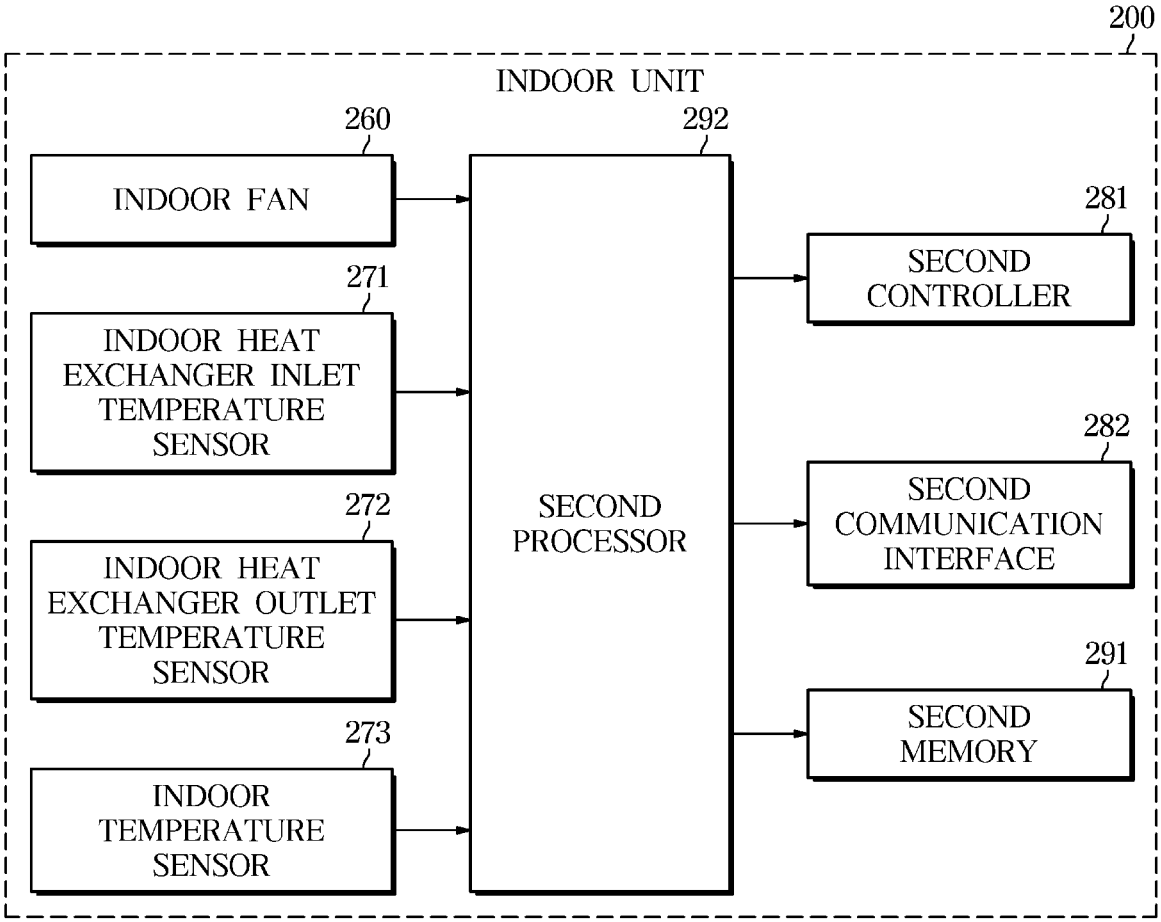
FIG. 4 is a diagram illustrating a control configuration of an indoor unit according to an embodiment of the disclosure.

FIG. 4 is a diagram illustrating a control configuration of the indoor unit according to an embodiment of the disclosure.

Referring to FIG. 4, the indoor unit 200 of the air conditioner 1 may include the indoor fan 260, the indoor heat exchanger inlet temperature sensor 271, the indoor heat exchanger outlet temperature sensor 272, the indoor temperature sensor 273, a second control panel 281, a second communication interface 282, a second memory 291, and a second processor 292.

The second processor 292 of the indoor unit 200 may be electrically connected to the components of the indoor unit 200 and may control the operation of each component. For example, the second processor 292 may adjust the rotation speed of the indoor fan 260 based on the air volume setting. Further, the second processor 292 may control the second communication interface 282 for communication with the outdoor unit 100.

The indoor heat exchanger inlet temperature sensor 271 may transmit an electrical signal corresponding to the detected inlet temperature to the second processor 292. The indoor heat exchanger outlet temperature sensor 272 may transmit an electrical signal corresponding to the detected outlet temperature to the second processor 292. The indoor temperature sensor 273 may transmit an electrical signal corresponding to the detected indoor temperature to the second processor 292.

The second control panel 281 may be provided on at least one of the body case 210 or the door 240 of the indoor unit 200. The second control panel 281 may obtain a user input related to the operation of the air conditioner 1, and may output information regarding the operation of the air conditioner 1. The second control panel 281 may transmit an electrical signal (voltage or current) corresponding to a user input to the second processor 292. The second processor 292 may control the operation of the air conditioner 1 based on the electrical signal transmitted from the second control panel 281.

The second control panel 281 may include a plurality of buttons. For example, the plurality of buttons may include an operation mode button for selecting an operation mode such as the cooling operation, the heating operation, the blowing operation, a defrosting operation, and a dehumidifying operation, and a temperature button for setting a target temperature of an indoor space (air conditioning space), a wind direction button for setting a wind direction and/or a wind volume button for setting a wind strength (rotation speed of the indoor fan). The second control panel 281 may also include a test operation button (not shown) for inputting a test operation command.

Further, the second control panel 281 may include a display. The display may display information input by the user or information provided to the user on various screens. For example, information such as the selected operation mode, wind direction, wind volume, and temperature may be displayed as at least one of an image or text. In addition, information about the test operation of the air conditioner 1 may be provided through the second control panel 281 of the indoor unit 200. In the same manner as the first control panel 191 of the outdoor unit 100, the second control panel 281 may include various display panels.

The second communication interface 282 may communicate with the outdoor unit 100. The second communication interface 282 of the indoor unit 200 may transmit the control signal, which is transmitted from the second processor 292, to the outdoor unit 100 or transmit the control signal, which is transmitted from the outdoor unit 200, to the second processor 292. For example, a control signal for outputting an error message related to the test operation and the test operation result may be transmitted from the outdoor unit 100 to the indoor unit 200. Based on the control signal transmitted from the outdoor unit 100, the second processor 292 of the indoor unit 200 may control the second control panel 281 to output information such as an error message, a test operation progress rate, and a test operation result generated in the test operation process.

The second communication interface 282 may communicate with an access point (AP) (not shown) separately provided in the air conditioning space, and may be connected to a network through the AP. The second communication interface 282 may communicate with a user terminal device (for example, a smart phone) through the AP. The second communication interface 282 may receive information on the user terminal device connected to the AP, and transmit the information on the user terminal device to the second processor 292. Accordingly, the user can remotely control the air conditioner 1.

The second communication interface 282 may receive location information (for example, a global positioning system (GPS) signal) of the user terminal device from the user terminal device, and transmit the received location information to the second processor 292. For this, the second communication interface 282 may include a known wired communication module or a wireless communication module.

The second memory 291 may memorize/store various types of information necessary for the operation of the air conditioner 1. The second memory 291 may store instructions, applications, data and/or programs necessary for the operation of the air conditioner 1. For example, the second memory 291 may store a program for the test operation of the air conditioner 1.

The second memory 291 may include a volatile memory for temporarily storing data such as a static random access memory (S-RAM) and a dynamic random access memory (D-RAM), and a non-volatile memory for storing data for a long period of time such as a read only memory (ROM), an erasable programmable read only memory (EPROM), and an electronically erasable programmable read only memory (EEPROM).

The second processor 292 may generate a control signal for controlling the operation of the air conditioner 1 based on instructions, applications, data, and/or programs stored in the second memory 291. The second processor 292 corresponding to hardware may include a logic circuit and an arithmetic circuit. The second processor 292 may process data according to a program and/or instructions provided from the second memory 291, and generate a control signal according to the processing result. The second memory 291 and the second processor 292 may be implemented as one control circuit or a plurality of circuits.

Some of the above-described components of the indoor unit 200 may be omitted, or other components may be added to the above-described components of the indoor unit 200. It will be readily understood by those of ordinary skill in the art that the mutual positions of the components may be changed in accordance with the performance or structure of the system.

As described in FIGS. 3 and 4, the air conditioner 1 may include at least one processor 192 and 292. Although it is described that the processor is provided in each of the outdoor unit 100 and the indoor unit 200, an integrated processor configured to control both the outdoor unit 100 and the indoor unit 200 may be provided.

At least one processor 192 and 292 of the air conditioner 1 may control the indoor unit 200 and the outdoor unit 100 to perform the test operation. For example, the first processor 192 of the outdoor unit 100 may perform the test operation by controlling the outdoor unit 100 and the indoor unit 200 based on a test operation command input through the test operation button of the first control panel 181. The test operation is performed to identify whether the air conditioner set operates normally after the air conditioner 1 is installed.

At least one processor 192 and 292 of the air conditioner 1 may perform the test operation in different modes based on the outdoor temperature. Based on the outdoor temperature being greater than or equal to a predetermined reference temperature (for example, 9° C.), the processors 192 and 292 may perform the test operation by performing the cooling operation.

Conversely, based on the outdoor temperature being less than the predetermined reference temperature (for example, 9° C.), the at least one processor 192 and 292 of the air conditioner 1 may continuously perform the heating operation and the defrosting operation during the test operation. The processors 192 and 292 may determine whether the indoor unit 200 and the outdoor unit 100 operate normally during the test operation. Continuously performing the heating operation and the defrosting operation may mean that the heating operation and the defrosting operation are sequentially performed. That is, during the test operation, the defrosting operation may be needed to be performed after the completion of the heating operation.

In addition, during the test operation, the defrosting operation may be performed according to conditions other than the outdoor temperature. For example, during the test operation, a test defrosting operation command for performing the defrosting operation may be input through the first control panel 181 of the outdoor unit 100 or the second control panel 281 of the indoor unit 200. The processors 192 and 292 of the air conditioner 1 may perform the defrosting operation as the test operation in response to receiving the test defrosting operation command.

As for the air conditioner 1 configured to perform both the cooling operation or the heating operation, the outdoor heat exchanger 130 may freeze and thus the outdoor heat exchanger 130 may not operate normally during the heating operation. In the conventional manner, during the heating operation, the defrosting operation is performed in response to the formation of frost in the outdoor heat exchanger 130. In other words, in the conventional manner, only when the heating performance is deteriorated due to the formation of frost in the outdoor heat exchanger 130, the defrosting operation is performed to remove the frost.

In a test operation stage, the disclosed air conditioner 1 forcibly enters the defrosting operation to determine whether the air conditioner 1 operates normally, after the heating operation. That is, during the test operation, the disclosed air conditioner 1 needs to perform the defrosting operation even under a condition in which the outdoor heat exchanger 130 does not freeze. Even if the frost is not formed in the outdoor heat exchanger 130, the defrosting operation may be forcibly performed and thus it is possible to more quickly identify whether a device such as the four-way valve 120 operates normally. If the defrosting operation is to be performed after the frost is formed in the outdoor heat exchanger 130, the test operation may not proceed until the formation of frost, and a waiting time may be required. However, regardless of whether or not the formation of frost in the outdoor heat exchanger 130, the defrosting operation may be immediately performed after the heating operation and thus it is possible to reduce a test operation time. Accordingly, by performing the heating operation and the defrosting operation continuously or sequentially during the test operation, it is possible to more quickly and more accurately identify check items such as whether the four-way valve 120 operates normally, whether the refrigerant flows in both directions, and whether the amount of the refrigerant is normal.

Based on the detection of an abnormal operation related to at least one of the indoor unit 200 and the outdoor unit 100, the processors 192 and 292 may control the control panels 181 and 281 to display an error message related to the abnormal operation, and stop the test operation.

In response to the start of the test operation, a communication state between the outdoor unit 100 and the indoor unit 200 may be checked. The checking of the communication state may be performed by identifying a response signal transmitted and received between the first communication interface 182 and the second communication interface 282 in a state in which the air conditioner 1 operates normally. In response to the lost communication between the outdoor unit 100 and the indoor unit 200, or in response to the unstable communication state between the outdoor unit 100 and the indoor unit 200, the processors 192 and 292 of the air conditioner 1 may control at least one of the first control panel 181 of the outdoor unit 100 or the second control panel 282 of the indoor unit 200 so as to display a communication state failure message as an error message indicating that the communication state fails.

In response to the determination that the communication state is normal, the outdoor fan 150 and the indoorfan 260 may be checked. The checking of the outdoor fan 150 and the indoor fan 260 may be performed in a state in which the compressor 110 does not operate. The processors 192 and 292 of the air conditioner 1 may determine whether the outdoor fan 150 and the indoor fan 260 operate normally while rotating the outdoor fan 150 and the indoor fan 260. It is possible to check whether other component of the air conditioner 1 operates normally while checking the outdoor fan 150 and the indoor fan 260.

In response to the normal operation of the outdoor fan 150 and the indoor fan 260, the cooling operation or the heating operation may be performed according to the outdoor temperature. That is, the refrigerant may be moved to the outdoor heat exchanger 130 and the indoor heat exchanger 250 by driving the compressor 110, and then whether the refrigerant flow is normal and whether the amount of refrigerant is normal may be determined.

The heating operation may be performed in response to the outdoor temperature being less than the reference temperature (for example, 9° C.) and after the completion of the heating operation, the defrosting operation may be performed. It is possible to more accurately determine whether the air conditioner 1 operates normally, by continuously performing the heating operation and the defrosting operation during the test operation. That is, by sequentially performing the heating operation and the defrosting operation during the test operation, it is possible to identify a pipe connection state and a high-pressure clogging error and to more accurately determine whether the refrigerant flow is normal and whether the refrigerant is insufficient. The high-pressure clogging error may be caused by events that disrupt refrigerant circulation, such as valve locking.

Whether the refrigerant flow is normal and whether the amount of refrigerant is normal may be determined based on the temperature of the indoor heat exchanger 250. For example, before driving the compressor 110 for the heating operation, the processors 192 and 292 may detect a first temperature of the indoor heat exchanger 250. The processors 192 and 292 may drive the compressor 110 for a predetermined time (for example, for 5 minutes) and control the four-way valve 120 and the expansion valve 140 to circulate the refrigerant. The operating frequency of the compressor 110 may be adjusted according to the number of indoor units 200 to be tested.

After driving the compressor 110, a second temperature of the indoor heat exchanger 250 may be detected, and whether the refrigerant flow is normal may be determined based on the first temperature of the indoor heat exchanger 250 and the second temperature of the indoor heat exchanger 250. During the heating operation, the first temperature and the second temperature of the indoor heat exchanger 250 may be measured by the indoor heat exchanger outlet temperature sensor 272 among the indoor heat exchanger temperature sensors 271 and 272.

Based on a difference between the first temperature of the indoor heat exchanger 250 and the second temperature of the indoor heat exchanger 250, being less than a predetermined reference value, the processors 192 and 292 of the air conditioner 1 may determine that the refrigerant flow is abnormal. That the difference, which is between the temperature of the indoor heat exchanger 250 measured before the compressor 110 is driven and the temperature of the indoor heat exchanger 250 measured after the compressor 110 is driven, is less than the reference value may mean that the high-pressure clogging error, indicating that the refrigerant does not flow through the indoor heat exchanger 250, occurs. This may be caused by a failure of a pipe connection, a closure of the pipe valve 98, a failure of the four-way valve 120, and/or a closure of the expansion valve 140.

Further, the processors 192 and 292 may control at least one of the first control panel 181 and the second control panel 281 to display the high-pressure clogging error message as the error message for notifying an abnormality of the refrigerant flow. The error message indicating at least one of the abnormal operation of the four-way valve 120, the abnormal operation of the expansion valve 140, or the closure of the pipe valve 98 coupled to the pipe 99 may be displayed. In response to the detection of the abnormality in the refrigerant flow, the outdoor unit 100 may stop the operation of the compressor 110.

In response to the difference between the first temperature of the indoor heat exchanger 250 and the second temperature of the indoor heat exchanger 250, being greater than or equal to the predetermined reference value, the processors 192 and 292 may determine that the refrigerant flow between the outdoor unit 100 and the indoor unit 200 is normal. This may mean that the pipe connection is normal, the pipe valve is opened, the four-way valve operates normally, and/or the expansion valve operates normally.

A method for determining whether the refrigerant flow is normal may vary and thus it is possible to check whether the refrigerant flow is normal by using other method other than the described method.

After the determination in which the refrigerant flow is normal, whether the amount of refrigerant is normal may be checked. Whether the amount of refrigerant is normal may be checked based on the inlet temperature of the indoor heat exchanger 250 and the outlet temperature of the indoor heat exchanger 250. In response to a difference between the inlet temperature and the outlet temperature of the indoor heat exchanger 250 serving as a condenser, being less than a predetermined reference subcooling degree (or supercooling degree), the processors 192 and 292 may determine that the amount of refrigerant is abnormal (the amount of refrigerant is insufficient). In this case, the processors 192 and 292 may control the first control panel 181 and/or the second control panel 281 to display a refrigerant insufficient error message.

In the condenser in which a refrigerant is condensed, a temperature at which a refrigerant is liquefied refers to a saturation condensation temperature. That the temperature of the liquid refrigerant is less than the saturation condensation temperature is called as subcooling (or supercooling). At the outlet side of the condenser in which the refrigerant is condensed, the temperature of the liquid refrigerant is less than the saturation condensation temperature.

The subcooling degree (or supercooling degree) means the difference between the saturation condensation temperature and the temperature of the subcooled(or supercooled) liquid refrigerant. When the refrigerant in the state in which the gaseous state and the liquid state are mixed enters the expansion valve 140, the normal operation of the expansion valve 140 is disturbed. In order to send the liquid refrigerant to the expansion valve 140, the refrigerant passing through the indoor heat exchanger 250 needs to be appropriately subcooled. For this, the air conditioner 1 is designed to maintain an appropriate subcooling degree.

During the heating operation, the high-temperature gaseous refrigerant discharged from the compressor 110 releases heat while passing through the indoor heat exchanger 250 and the phase of the refrigerant is changed to a liquid phase. In a state in which the amount of the refrigerant, which is subcooled while passing through the indoor heat exchanger 250, is insufficient, a temperature at the outlet side (an inlet side based on the cooling operation) of the indoor heat exchanger 250 from which the liquid refrigerant is discharged becomes greater than the normal temperature. Therefore, a subcooling degree in the state in which the refrigerant is insufficient is less than a reference subcooling degree. In this case, an error message indicating that the amount of refrigerant is insufficient may be displayed through the first control panel 181 and/or the second control panel 281.

In a state in which the amount of refrigerant is greater than the normal amount, the temperature at the outlet side (the inlet side based on the cooling operation) of the indoor heat exchanger 250 from which the liquid refrigerant is discharged during the heating operation becomes less than the normal temperature. Because the subcooled liquid refrigerant is excessively accumulated on the outlet side of the indoor heat exchanger 250 serving as a condenser, the outlet temperature of the indoor heat exchanger 250 from which the liquid refrigerant is discharged is less than the normal temperature. Therefore, based on the refrigerant being excessive, the subcooling degree is greater than the reference subcooling degree. In this case, an error message indicating that the amount of refrigerant is excessive may be displayed through the first control panel 181 and/or the second control panel 281.

In response to a difference between the inlet temperature of the indoor heat exchanger 250 between the outlet temperature of the indoor heat exchanger 250 during the heating operation, being equal to a predetermined reference subcooling degree, the processors 192 and 292 may determine that the refrigerant amount is normal. In this case, a message indicating that the amount of refrigerant is normal may be displayed through the first control panel 181 and/or the second control panel 281.

Meanwhile, whether the refrigerant flow is normal and whether the amount of refrigerant is insufficient may be determined by comparing the difference between the inlet temperature and the outlet temperature of the indoor heat exchanger 250 during the cooling operation, with the reference subcooling degree. It is possible to use various methods for determining whether the refrigerant flow is normal and whether the refrigerant amount is insufficient.

The defrosting operation may be performed after the completion of the heating operation. That is, the heating operation and the defrosting operation may be performed continuously or sequentially. In response to the completion of the heating operation, the first processor 192 of the outdoor unit 100 may stop the operation of the compressor 110, the outdoor fan 150, and the indoor fan 260, and control the four-way valve 120 to switch the circulation direction of the refrigerant. The first processor 192 of the outdoor unit 100 drives the compressor 110 again, and the refrigerant flows from the compressor 110 to the outdoor heat exchanger 130. Because the refrigerant releases heat to the outdoor heat exchanger 130, the temperature of the outdoor heat exchanger 130 measured by the outdoor heat exchanger temperature sensor 172 provided on one side of the outdoor heat exchanger 130 may be increased.

The processors 192 and 292 may terminate the defrosting operation based on the temperature of the outdoor heat exchanger 130 being greater than or equal to a predetermined defrost cancellation temperature (for example, 10° C.). That the temperature of the outdoor heat exchanger 130 is increased to be greater than or equal to the defrost cancellation temperature may mean that the defrosting operation is performed normally. Accordingly, the defrosting operation may be terminated and it may be determined that and the four-way valve 120 and the expansion valve 140 operate normally.

Conversely, in response to the temperature of the outdoor heat exchanger 130 after switching from the heating operation to the defrosting operation, being less than the defrost cancellation temperature, the processors 192 and 292 may determine that the defrosting operation is performed abnormally. In this case, it may be determined that the four-way valve 120 and/or the expansion valve 140 operate abnormally. An error message regarding a defrosting operation failure may be displayed through the first control panel 181 and/or the second control panel 281.

As described above, by performing the test operation, in which the heating operation and the defrosting operation are continuously performed, in response to the outdoor temperature being relatively low, it is possible to more accurately determine whether the air conditioner operates normally. In addition, by performing the defrosting operation during the test operation regardless of whether or not the formation of frost in the outdoor heat exchanger 130, a time required to complete the test operation may be reduced.

Figure 5:
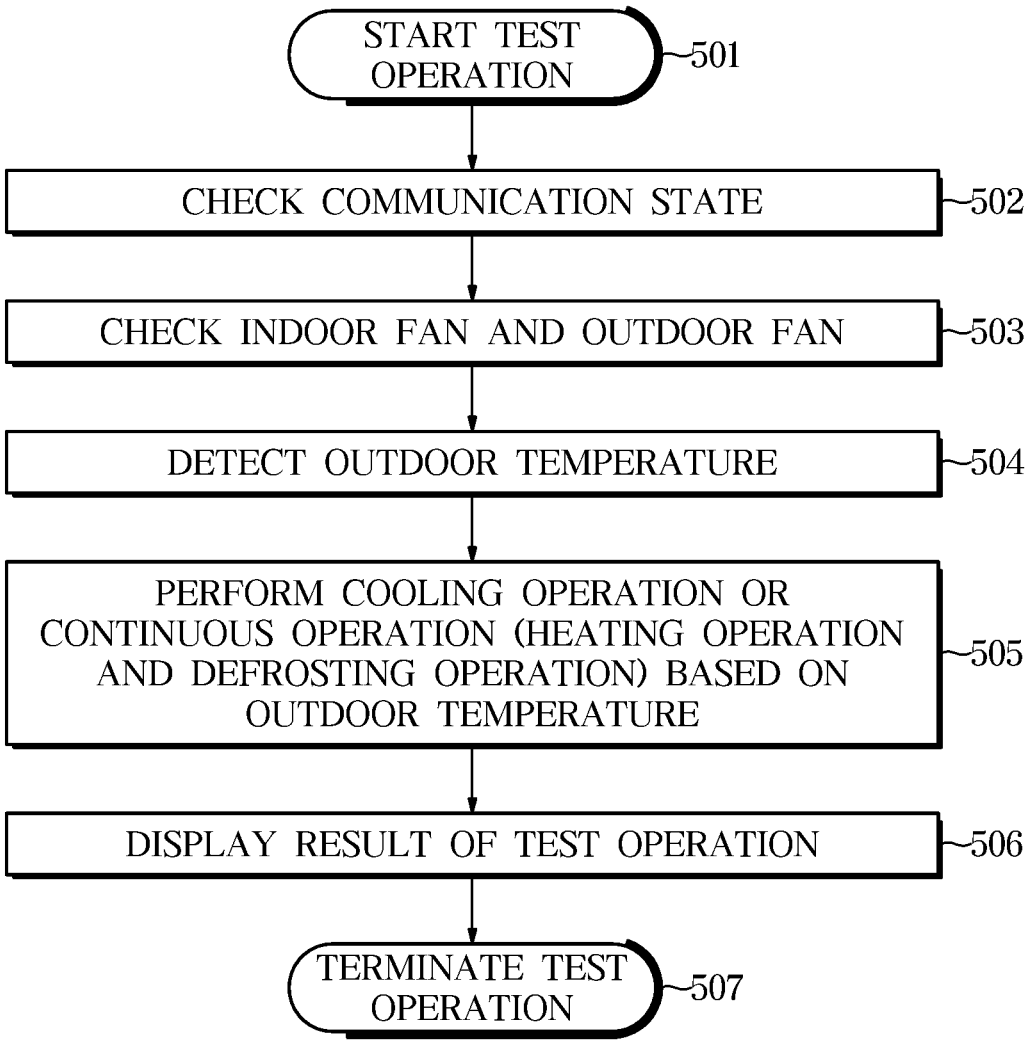
FIG. 5 is a flowchart illustrating a control method of the air conditioner for a test operation of the air conditioner according to an embodiment of the disclosure.

FIG. 5 is a flowchart illustrating a control method of the air conditioner for the test operation of the air conditioner according to an embodiment of the disclosure.

Referring to FIG. 5, at least one of the processors 192 and 292 of the air conditioner 1 may start the test operation based on an input of a test operation command (501). For example, the test operation command may be input through the test operation button of the first control panel 181 provided in the outdoor unit 100.

Alternatively, the test operation button may be provided on the second control panel 281 of the indoor unit 200.

In response to the start of the test operation, the communication state between the outdoor unit 100 and the indoor unit 200 may be checked (502). In response to the lost communication or the unstable communication between the outdoor unit 100 and the indoor unit 200, the processors 192 and 292 of the air conditioner 1 may control at least one of the first control panel 181 of the outdoor unit 100 and/or the second control panel 282 of the indoor unit 200 so as to notify an error message indicating that the communication state fails. Further, in response to the abnormal communication state between the outdoor unit 100 and the indoor unit 200, the test operation may be stopped.

The outdoor fan 150 and the indoor fan 260 may be checked while the compressor 110 does not operate (503). An assembly state of other components of the air conditioner 1 and whether other components operate normally may also be checked while the outdoor fan 150 and the indoor fan 260 are checked. Based on the detection of abnormal operation of the outdoor fan 150 and the indoor fan 260, the processors 192 and 292 may control the first control panel 181 and/or the second control panel 282 so as to display a fan error message.

In response to the normal operation of the outdoor fan 150 and the indoor fan 260, the first processor 192 of the outdoor unit 100 may control the outdoor temperature sensor 171 to detect the outdoor temperature (504). The processors 192 and 292 of the air conditioner 1 may perform the cooling operation or continuously perform the heating operation and the defrosting operation based on the detected outdoor temperature (505). For example, based on the outdoor temperature being less than the reference temperature (for example, 9° C.), the heating operation and the defrosting operation may be continuously or sequentially performed. Whether the outdoor unit 100 and the indoor unit 200 operate normally may be checked while the heating operation and the defrosting operation are performed.

The processors 192 and 292 may display the test operation result and terminate the test operation (506, and 507). Based on the detection of the abnormal operation related to at least one of the indoor unit 200 or the outdoor unit 100 during the test operation process, the processors 192 and 292 may control the control panels 181 and 281 to display an error message related to the abnormal operation, and stop the test operation. In response to the normal operation of the outdoor unit 100 and the indoor unit 200, the processors 192 and 292 may control the control panels 181 and 281 to display a message indicating the normal operation.

Figure 6:
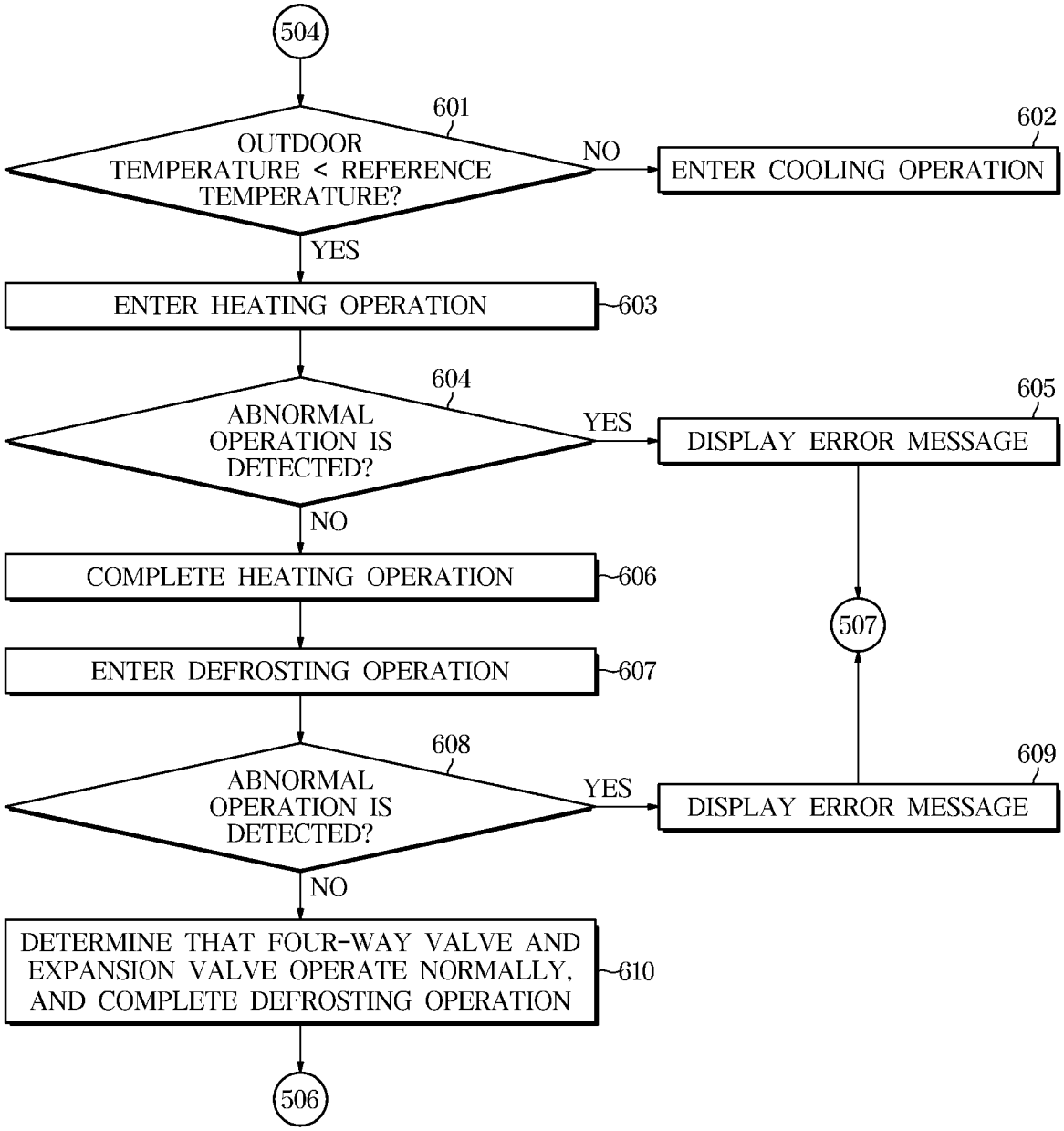
FIG. 6 is a flowchart specifically illustrating a heating operation and a defrosting operation continuously performed during the test operation process illustrated in FIG. 5.

FIG. 6 is a flowchart specifically illustrating the heating operation and the defrosting operation continuously performed during the test operation process illustrated in FIG. 5.

Referring to FIG. 6, based on the outdoor temperature being greater than or equal to the predetermined reference temperature (for example, 9° C.), the air conditioner 1 may enter the cooling operation (601 and 602). Conversely, based on the outdoor temperature being less than the reference temperature (for example, 9° C.), the air conditioner 1 may enter the heating operation (601 and 603).

Based on the detection of the abnormal operation related to at least one of the indoor unit 200 or the outdoor unit 100 during the heating operation, the processors 192 and 292 may control the control panels 181 and 281 to display an error message related to the abnormal operation, and stop the test operation (604 and 605).

In response to the non-detection of the abnormal operation during the heating operation, the air conditioner 1 may complete the heating operation and enter the defrosting operation (606 and 607). In response to the completion of the heating operation, the air conditioner 1 may control the compressor 110 and the four-way valve 120 to switch the operation to the defrosting operation. In response to the detection of the abnormal operation during the defrosting operation, the air conditioner 1 may control the control panels 181 and 281 to display an error message related to the abnormal operation, and stop the test operation (608 and 609).

In response to the non-detection of the abnormal operation during the defrosting operation, the air conditioner 1 may determine that the four-way valve 120 and the expansion valve 140 operate normally, and may complete the defrosting operation (610). As described above, by continuously performing the heating operation and the defrosting operation during the test operation, it is possible to more accurately determine whether the air conditioner 1 operates normally.

Figure 7:
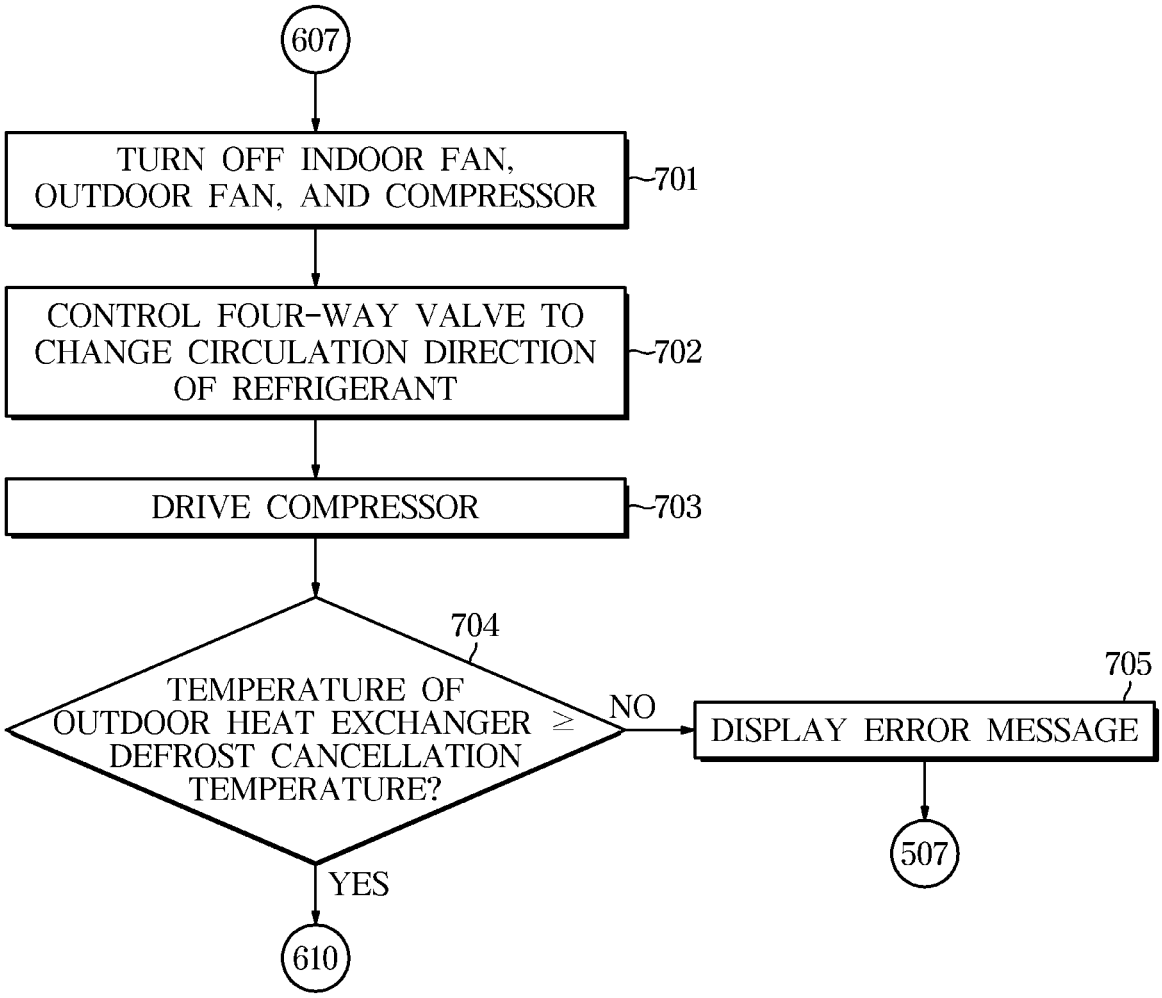
FIG. 7 is a flowchart illustrating a method of determining whether the air conditioner is normal during the defrosting operation described in FIG. 6.

FIG. 7 is a flowchart illustrating a method of determining whether the air conditioner is normal during the defrosting operation described in FIG. 6.

Referring to FIG. 7, after the completion of the heating operation, the air conditioner 1 may stop the operation of the compressor 110, the outdoor fan 150, and the indoor fan 260 (701) and control the four-way valve 120 to change the circulation direction of the refrigerant (702). Thereafter, the air conditioner 1 may drive the compressor 110 again (703). Accordingly, the refrigerant may flow from the compressor 110 to the outdoor heat exchanger 130.

The air conditioner 1 may control the outdoor heat exchanger temperature sensor 172 to detect the temperature of the outdoor heat exchanger 130. Because the refrigerant in the compressor 110 releases heat while passing through the outdoor heat exchanger 130, the temperature of the outdoor heat exchanger 130 may be increased. The air conditioner 1 may terminate the defrosting operation based on the temperature of the outdoor heat exchanger 130 being greater than or equal to the predetermined defrost cancellation temperature (for example, 10° C.) and terminate the test operation (704).

However, in response to the temperature of the outdoor heat exchanger 130 being less than the defrost cancellation temperature after the completion of the defrosting operation, the air conditioner 1 may determine that the defrosting operation is performed abnormally. In this case, the air conditioner 1 may display an error message regarding the defrosting operation failure through the first control panel 181 and/or the second control panel 281 (705).

Figure 8:
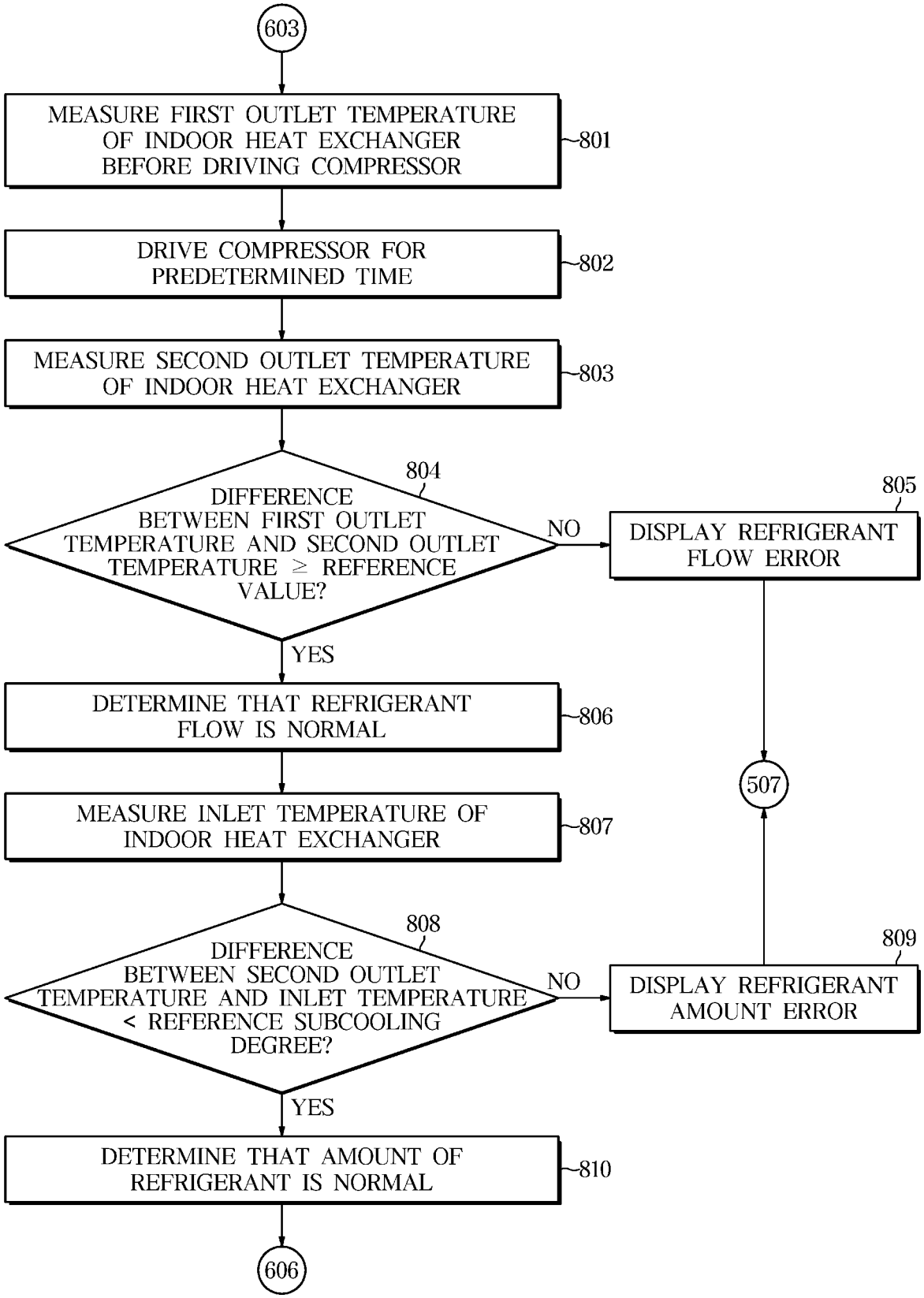
FIG. 8 is a flowchart illustrating a method of determining whether the air conditioner operates normally by determining whether a refrigerant flow and an amount of refrigerant are normal during the heating operation described in FIG. 6.

FIG. 8 is a flowchart illustrating a method of determining whether the air conditioner operates normally by determining whether a refrigerant flow and an amount of refrigerant are normal during the heating operation described in FIG. 6.

Referring to FIG. 8, after entering the heating operation, the air conditioner 1 may detect the first temperature of the indoor heat exchanger 250 before driving the compressor 110 (801). Because the inlet and outlet of the indoor heat exchanger 250 are defined based on the cooling operation, the first temperature of the indoor heat exchanger 250 may be referred to as a first outlet temperature during the heating operation in which the circulation direction of the refrigerant is opposite.

Thereafter, the air conditioner 1 may drive the compressor 110 for a predetermined time (for example, for 5 minutes) and detect the second temperature of the indoor heat exchanger 250. The second temperature of the indoor heat exchanger 250 may be referred to as a second outlet temperature. In other words, the first temperature and the second temperature of the indoor heat exchanger 250 during the heating operation may be measured by the indoor heat exchanger outlet temperature sensor 272 among the indoor heat exchanger temperature sensors 271 and 272.

Based on the difference between the first temperature of the indoor heat exchanger 250 and the second temperature of the indoor heat exchanger 250 being less than the predetermined reference value, the air conditioner 1 may determine that the refrigerant flow is abnormal, and display the refrigerant flow error through the first control panel 181 and/or the second control panel 281 (804 and 805).

Based on the difference between the first temperature of the indoor heat exchanger 250 and the second temperature of the indoor heat exchanger 250 being greater than or equal to the predetermined reference value, the air conditioner 1 may determine that the refrigerant flow is normal (806). A method for determining whether the refrigerant flow is normal may vary and thus it is possible to check whether the refrigerant flow is normal, by using other method other than the described method.

After the determination in which the refrigerant flow is normal, whether the amount of refrigerant is normal may be checked. The air conditioner 1 may control the indoor heat exchanger inlet temperature sensor 271 to detect the inlet temperature of the indoor heat exchanger 250 (807).

In response to a difference between the inlet temperature and the outlet temperature of the indoor heat exchanger 250 serving as a condenser during the heating operation, being less than a predetermined reference subcooling degree, the air conditioner 1 may determine that the amount of refrigerant is abnormal (the amount of refrigerant is insufficient). In this case, the air conditioner 1 may control the first control panel 181 and/or the second control panel 281 to display the refrigerant amount error message (808 and 809).

In response to the difference between the inlet temperature and the outlet temperature of the indoor heat exchanger 250 during the heating operation, being greater than the predetermined reference subcooling degree, the air conditioner 1 may determine that the amount of refrigerant is greater than the reference amount. In this case, an error message indicating that the amount of refrigerant is excessive may be displayed through the first control panel 181 and/or the second control panel 281.

In response to the difference between the inlet temperature and the outlet temperature of the indoor heat exchanger 250 during the heating operation, being equal to the predetermined reference subcooling degree, the air conditioner 1 may determine that the amount of refrigerant is normal (810). In this case, a message indicating that the amount of refrigerant is normal may be displayed through the first control panel 181 and/or the second control panel 281.

As is apparent from the above description, an air conditioner and a control method may more accurately determine whether the air conditioner operates normally, by performing a test operation by continuously performing heating and defrosting operations in response to an outdoor temperature being relatively low. That is, a state of a pipe connection, a four-way valve, and an expansion valve may all be checked through the heating operation and the defrosting operation. In addition, by performing the defrosting operation during the test operation regardless of whether or not the formation of frost in an outdoor heat exchanger, it is possible to reduce a time required to complete the test operation.

An air conditioner and a control method may notify a user of an occurrence of an abnormal operation and a cause of the abnormal operation during a test operation.

Accordingly, an installation quality of the air conditioner may be improved, and customer reliability may be increased.

Meanwhile, the disclosed embodiments may be embodied in the form of a recording medium storing instructions executable by a computer. The instructions may be stored in the form of program code and, when executed by a processor, may generate a program module to perform the operations of the disclosed embodiments. The recording medium may be embodied as a computer-readable recording medium.

Storage medium readable by machine, may be provided in the form of a non-transitory storage medium. "Non-transitory" means that the storage medium is a tangible device and does not contain a signal (e.g., electromagnetic wave), and this term includes a case in which data is semi-permanently stored in a storage medium and a case in which data is temporarily stored in a storage medium.

The method according to the various disclosed embodiments may be provided by being included in a computer program product. Computer program products may be traded between sellers and buyers as commodities. Computer program products are distributed in the form of a device-readable storage medium (e.g., compact disc read only memory (CD-ROM)), or are distributed directly or online (e.g., downloaded or uploaded) between two user devices (e.g., smartphones) through an application store (e.g., Play Store™). In the case of online distribution, at least a portion of the computer program product (e.g., downloadable app) may be temporarily stored or created temporarily in a device-readable storage medium such as the manufacturer's server, the application store's server, or the relay server's memory.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. An air conditioner comprising:

an indoor unit comprising an indoor heat exchanger and an indoor fan;

an outdoor unit connected to the indoor unit and comprising an outdoor heat exchanger, an outdoor fan, a compressor, an expansion valve, an outdoor temperature sensor, and a four-way valve; and at least one processor configured to perform a test operation to determine whether the indoor unit and the outdoor unit are operating normally by controlling the indoor unit and the outdoor unit to sequentially perform a heating operation and a defrosting operation, wherein, during the test operation, both the heating operation and the defrosting operation are performed based on an outdoor temperature detected by the outdoor temperature sensor being less than a predetermined reference temperature.

2. The air conditioner of claim 1, wherein the at least one processor is configured to switch to the defrosting operation from the heating operation by controlling the compressor and the four-way valve, based on the heating operation being complete.

3. The air conditioner of claim 1, wherein the at least one processor is configured to terminate the defrosting operation based on a temperature of the outdoor heat exchanger detected by an outdoor heat exchanger temperature sensor being greater than or equal to a defrost cancellation temperature, and p1 determine that the four-way valve and the expansion valve operate normally.

4. The air conditioner of claim 1, wherein the at least one processor is configured to determine whether a refrigerant flow is normal, based on a first temperature of the indoor heat exchanger detected by an indoor heat exchanger outlet temperature sensor before driving the compressor for the heating operation, and a second temperature of the indoor heat exchanger detected by the indoor heat exchanger outlet temperature sensor after driving the compressor for a predetermined time.

5. The air conditioner of claim 4, wherein the at least one processor is configured to determine that the refrigerant flow is abnormal, based on a difference between the first temperature of the indoor heat exchanger and the second temperature of the indoor heat exchanger, being less than a predetermined reference value.

6. The air conditioner of claim 5, further comprising:

a control panel provided on at least one of the indoor unit or the outdoor unit;

wherein based on the refrigerant flow being abnormal, the at least one processor is configured to control the control panel to display an error message indicating at least one of an abnormal operation of the four-way valve, an abnormal operation of the expansion valve, or a closure of a pipe valve coupled to a pipe.

7. The air conditioner of claim 1, wherein the at least one processor is configured to determine whether a communication state between the indoor unit and the outdoor unit is normal before a start of the heating operation.

8. The air conditioner of claim 1, wherein the at least one processor is configured to determine whether the indoor fan and the outdoor fan operate normally before a start of the heating operation.

9. The air conditioner of claim 1, further comprising:

a control panel provided on at least one of the indoor unit or the outdoor unit;

wherein based on the detection of an abnormal operation related to at least one of the indoor unit or the outdoor unit, the at least one processor is configured to control the control panel to display an error message related to the abnormal operation and to stop the test operation.

10. A control method of an air conditioner comprising an indoor unit and an outdoor unit, the control method comprising:

performing a test operation of the indoor unit and the outdoor unit based on an input of a test operation command, wherein the performing of the test operation comprises:

detecting an outdoor temperature by an outdoor temperature sensor;

determining whether the indoor unit and the outdoor unit operate normally based on the outdoor temperature being less than a predetermined reference temperature, by sequentially performing both a heating operation and a defrosting operation during the test operation; and displaying information related to whether the indoor unit and the outdoor unit operate normally.

11. The control method of claim 10, wherein the performing of both the heating operation and the defrosting operation comprises switching to the defrosting operation from the heating operation by controlling a compressor and a four-way valve, based on the heating operation being complete.

12. The control method of claim 10, wherein the determination of whether the indoor unit and the outdoor unit operate normally comprises terminating the defrosting operation based on a temperature of an outdoor heat exchanger detected by an outdoor heat exchanger temperature sensor being greater than or equal to a defrost cancellation temperature, and determining that a four-way valve and an expansion valve operate normally.

13. The control method of claim 10, wherein the determination of whether the indoor unit and the outdoor unit operate normally comprises determining whether a refrigerant flow is normal, based on a first temperature of an indoor heat exchanger detected by an indoor heat exchanger outlet temperature sensor before driving a compressor for the heating operation, and a second temperature of the indoor heat exchanger detected by the indoor heat exchanger outlet temperature sensor after driving the compressor for a predetermined time.

14. The control method of claim 13, wherein the determination of whether the refrigerant flow is normal comprises determining that the refrigerant flow is abnormal, based on a difference between the first temperature of the indoor heat exchanger and the second temperature of the indoor heat exchanger, being less than a predetermined reference value.

15. The control method of claim 14, wherein the displaying of the information comprises displaying an error message indicating at least one of an abnormal operation of a four-way valve, an abnormal operation of an expansion valve, or a closure of a pipe valve coupled to a pipe, based on the abnormality of the refrigerant flow.

* * * * *